US012703601B2

(12) United States Patent
Horn

(10) Patent No.: US 12,703,601 B2
(45) Date of Patent: Aug. 11, 2026

(54) HOSE DEPLOYMENT AND RETRIEVAL DEVICE

(71) Applicant: Elevate Energy Services, LLC, Greeley, CO (US)

(72) Inventor: Craig Horn, Kalispell, MT (US)

(73) Assignee: Elevate Energy Services, LLC, Greeley, CO (US)

( * ) Notice: Subject to any disclaimer, the term of this patent is extended or adjusted under 35 U.S.C. 154(b) by 27 days.

(21) Appl. No.: 18/439,599

(22) Filed: Feb. 12, 2024

(65) Prior Publication Data

US 2024/0270537 A1 Aug. 15, 2024

Related U.S. Application Data

(60) Provisional application No. 63/444,604, filed on Feb. 10, 2023.

(51) Int. Cl.
*B65H 75/42* (2006.01)
*B65H 49/32* (2006.01)

(52) U.S. Cl.
CPC ..... *B65H 75/425* (2013.01); *B65H 49/32* (2013.01); *B65H 2701/33* (2013.01)

(58) Field of Classification Search
CPC ..... B65H 75/42; B65H 75/425; B65H 49/32; B65H 2701/33; B65H 2701/332; B65H 2701/333
See application file for complete search history.

(56) References Cited

U.S. PATENT DOCUMENTS 4,664,331 A * 5/1987 Halbrook ..... B65H 49/32 254/323
2014/0224917 A1* 8/2014 Turner ..... B65H 75/4481 242/400
2014/0312156 A1* 10/2014 Minino ..... B65H 75/425 242/397
2016/0194178 A1* 7/2016 Braack ..... B65H 75/4481 242/388.8
2018/0370755 A1* 12/2018 Zimmerman ..... B65H 75/4457
2019/0023520 A1* 1/2019 Robertson ..... B65H 59/04

* cited by examiner

*Primary Examiner* — Sang K Kim
(74) *Attorney, Agent, or Firm* — NOD Law PC

(57) ABSTRACT

A frame assembly for a hose deployment/retrieval system, comprising pair of distal vertical arms and a pair of proximal vertical arms. Horizontal beams connect the distal vertical arms and the proximal vertical arms at a top and bottom portion of the vertical arms. A cross beam is fixedly coupled across the proximal vertical arms adjacent to an attachment plate coupled to a back side of the proximal vertical arms. A second cross beam is coupled to a different portion of the proximal vertical arms at a height that is adjacent a height of the top of the attachment plate.

13 Claims, 10 Drawing Sheets

HOSE DEPLOYMENT AND RETRIEVAL DEVICE

CROSS-REFERENCE TO OTHER APPLCIATIONS

This application claims priority to, and the benefit of, U.S. Provisional Application No. 63/444,604, entitled "HOSE DEPLOYMENT AND RETRIEVAL DEVICE," filed Feb. 10, 2023 which is incorporated herein by reference.

FIELD OF THE DISCLOSURE

The present disclosure relates generally to a hose deployment and retrieval device. In particular, but not by way of limitation, the present disclosure relates to systems, methods and apparatuses for deploying and retrieving hoses.

DESCRIPTION OF RELATED ART

Hose deployment/retrieval devices, such as those used in the hydraulic fracking industry, are primarily metal and thus heavy with a center of gravity (CG) relatively far forward from the vehicle (e.g., skid steer) used to transport and deploy the hose. In some circumstances, the position of the CG may cause the vehicle transporting the device to become unstable and even risk tipping over, especially for larger diameter hoses (e.g., >12 inches). Thus, current hose deployments are often limited to hoses of 12 inches or smaller in diameter, which thereby limits fluid flow rates. Thus, there is a need for a refined hose deployment device that can not only transport larger diameter hoses (e.g., 14 inches, 16 inches), but also minimize or reduce the susceptibility of the vehicle to tipping.

The description provided in the description of related art section should not be assumed to be prior art merely because it is mentioned in or associated with this section. The description of related art section may include information that describes one or more aspects of the subject technology.

SUMMARY OF THE DISCLOSURE

The following presents a simplified summary relating to one or more aspects and/or embodiments disclosed herein. As such, the following summary should not be considered an extensive overview relating to all contemplated aspects and/or embodiments, nor should the following summary be regarded to identify key or critical elements relating to all contemplated aspects and/or embodiments or to delineate the scope associated with any particular aspect and/or embodiment. Accordingly, the following summary has the sole purpose to present certain concepts relating to one or more aspects and/or embodiments relating to the mechanisms disclosed herein in a simplified form to precede the detailed description presented below.

Broadly, aspects of the present disclosure are directed to a hose deployment and retrieval device that helps overcome some of the deficiencies of prior art systems, such as allowing deployment of larger-diameter hoses. The hose deployment and retrieval device (or simply, hose system) is designed such that its center of gravity (CG) is positioned closer to the vehicle (e.g., skid steer, backhoe, etc.) used to transport and deploy the hose system than has been possible in the art. In some examples, the hose system may comprise at least a frame, a wheel hub and tire assembly, an attachment plate (i.e., used to attach the hose system to the skid steer), a motor, one or more pneumatic assemblies, a plurality of claws, and a plurality of rollers, amongst other components, further described below in relation to FIGS. 1-6. The hose system is configured to support a hose reel (or hose spool) around which a hose (e.g., ~12-16 inch in diameter) is wound. In one non-limiting example, the hose may have a length that is anywhere between 500-1000 feet, although other hose lengths (e.g., >0.5 miles, >1 mile) are contemplated in different embodiments.

In some embodiments, a hose deployment and retrieval system is provided comprising: a frame assembly with a plurality of vertical arms positioned at both front and rear sides of the hose deployment and retrieval system, with a front vertical arms angled with respect to a rear vertical arms; a plurality of horizontal arms attached to pairs of vertical arms, each pair comprising a rear perpendicular vertical arm and a front angled vertical arm; an attachment plate positioned at a rear side of the system and coupled to each of the rear vertical arms, the attachment plate being configured for skid steer attachment; a drive wheel assembly and a dynamic fluid component coupled to the frame assembly, the drive wheel assembly comprising a rubber tire configured to contact a hose reel and facilitate hose deployment and retrieval, the drive wheel assembly being driven by a motor. In various embodiments, each of the angled vertical arms is positioned at an angle between 15-30 degrees with respect to a perpendicular axis.

In some embodiments, each horizontal arm spans between the vertical arms of a corresponding pair of vertical arms and is slightly longer than a maximum separation between the respective vertical arms. In some embodiments, the attachment plate is at least as wide as a separation between the rear vertical arms. In various embodiments, the hose deployment and retrieval system further comprises two horizontal arms positioned at a bottom side of the frame assembly, each distal horizontal arm positioned between the vertical arms of a corresponding pair of vertical arms, and each proximal horizontal arm being longer than the distal horizontal arms. In some embodiments, the frame assembly further comprises: two claw assemblies, wherein each claw assembly positioned on one of the proximal horizontal arms, the two claw assemblies configured to facilitate secure attachment of spool adapter attachments; and two pneumatic assemblies, wherein each pneumatic assembly is coupled to the proximal horizontal arms and the claw assemblies, enabling adjustment for securing spool adapter attachments of different sizes. In some embodiments, the hose deployment and retrieval system further comprising roller guide wheels positioned on proximal horizontal arms. In various embodiments, the attachment plate is configured for use with a telehandler, the attachment plate comprising a solid metal plate affixed to the frame assembly, and further comprising two elongated and generally rectangular side plates extending outward from a back side of the frame assembly, wherein the side plates are coupled together by one or more beams spanning horizontally between the side plates.

In many embodiments, the hose deployment and retrieval system further comprises: a hose spool having a radius; and a cross beam positioned to allow a portion of the radius of the hose spool to extend behind the rear perpendicular vertical arms when the hose spool is attached to the frame assembly; wherein the radius of the hose spool being supported by the hose deployment and retrieval system based at least in part on a length of the longer pair of horizontal arms. In some embodiments, the angle of the front angled vertical arms with respect to the horizontal arms is selected based on the radius of the hose spool.

In many embodiments, a hose deployment and retrieval system is provided comprising: a frame assembly having a front angled vertical arms and rear perpendicular vertical arms; a plurality of horizontal arms attached to pairs of vertical arms, each pair comprising a front angled vertical arm and a rear perpendicular vertical arm; an attachment plate positioned at a rear side of the frame assembly and coupled to each of the rear perpendicular vertical arms; a hose spool having a radius; and a horizontal beam positioned to allow a portion of the radius of the hose spool to extend behind the rear perpendicular vertical arms when the hose spool is attached to the frame assembly; wherein the radius of the hose spool being supported by the hose deployment and retrieval system based at least in part on a length of a longer proximal horizontal arm. In some embodiments, the radius of the hose spool is substantially equal to the length of the proximal horizontal arm. In many embodiments, the angle of the front angled vertical arms with respect to the horizontal arms is selected based on the radius of the hose spool and a bottom of the hose spool is positioned at or around a middle of the attachment plate. In some embodiments, the horizontal beam is configured to shift some of a weight of the hose spool rearward and closer to a transport vehicle. In some embodiments, the frame has a taller than wide cross section, and wherein the vertical arms are longer than the horizontal arms; and the frame assembly configured to allow a portion of the radius of the hose spool to extend behind the rear vertical arms.

Embodiments of a frame assembly for a hose deployment/retrieval system are also provided, comprising: a first distal vertical arm and a second distal vertical arm; a first proximal vertical arm and a second proximal vertical arm; a first horizontal arm connecting the first distal vertical arm and the first proximal vertical arm at a top portion of the first distal vertical arm and the first proximal vertical arm; a second horizontal arm connecting the first distal vertical arm and the first proximal vertical arm at a bottom portion of the first distal vertical arm and the first proximal vertical arm; a third horizontal arm connecting the second distal vertical arm and the second proximal vertical arm at a top portion of the second distal vertical arm and the second proximal vertical arm; a fourth horizontal arm connecting the second distal vertical arm and the second proximal vertical arm at a bottom portion of the second distal vertical arm and the second proximal vertical arm; a first cross beam fixedly coupled to the first proximal vertical arm and the second proximal vertical arm, wherein the first cross beam is arranged adjacent to an attachment plate of the frame assembly; wherein the attachment plate is coupled to a back side of the first proximal vertical arm and a back side of the second proximal vertical arm; and a second cross beam coupled to a different portion of the first proximal vertical arm and the second proximal vertical arm, wherein the second cross beam is coupled at a height along the first proximal vertical arm and the second proximal vertical arm adjacent a height of a top of the attachment plate.

In some embodiments, the frame assembly further comprises a reinforcement plate arranged adjacent to and along a top of the attachment plate, wherein the reinforcement plate is fixedly coupled to a back side of the attachment plate at or near a height of the second cross beam. In some embodiments, the frame assembly further comprises a hose spool having a radius; and the first cross beam positioned to allow a portion of the radius of the hose spool to extend behind the proximal vertical arms when the hose spool is attached to the frame assembly; wherein the radius of the hose spool being supported by the frame assembly based at least in part on a length of the first horizontal arm and a length of the third horizontal arm. In various embodiments, the radius of the hose spool is substantially equal to a length of the first horizontal arm and a length of the third horizontal arm.

BRIEF DESCRIPTION OF THE DRAWINGS

Various objects and advantages and a more complete understanding of the present disclosure are apparent and more readily appreciated by referring to the following detailed description and to the appended claims when taken in conjunction with the accompanying drawings:

DETAILED DESCRIPTION

Figure 1:
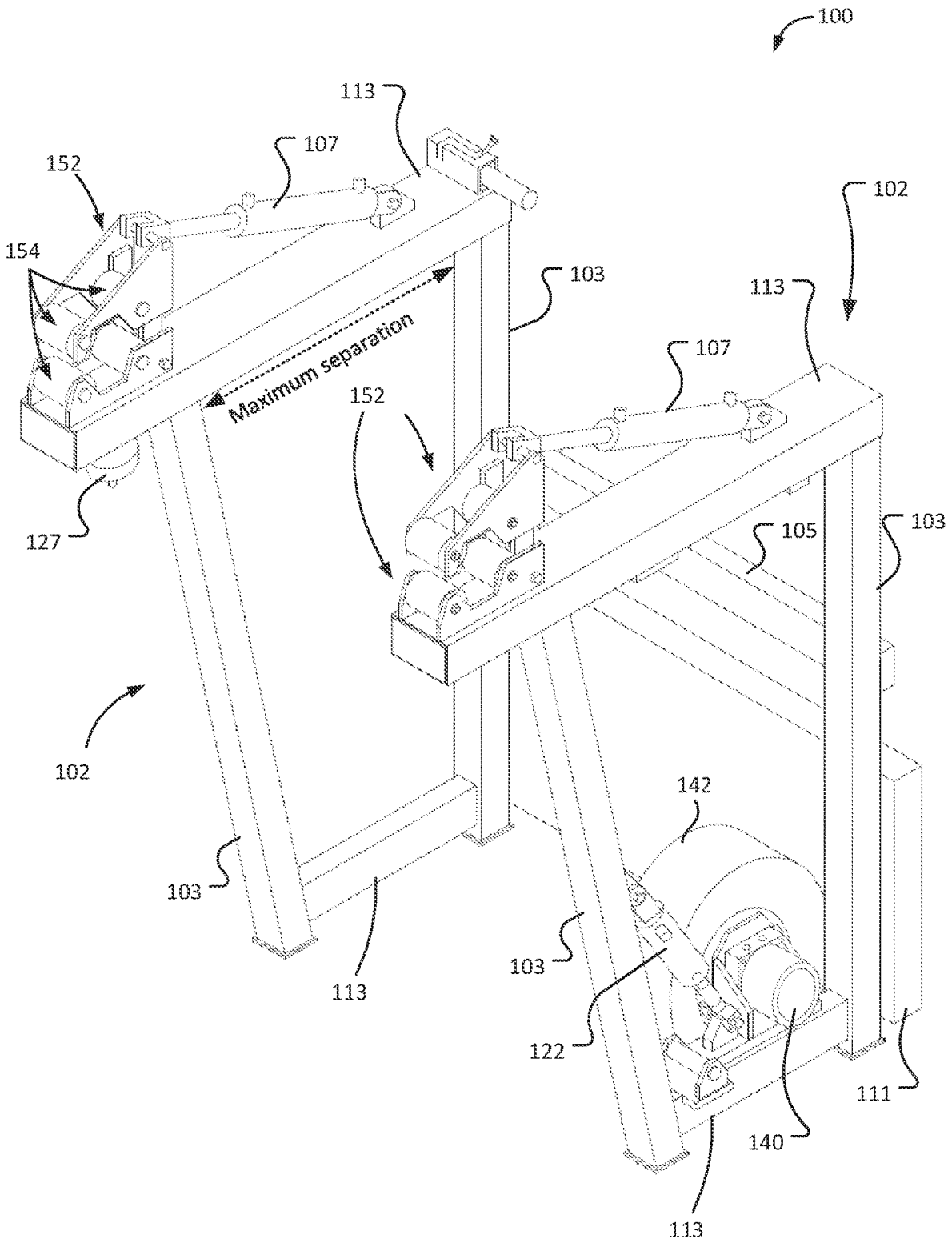
FIG. 1 illustrates an isometric view of a hose deployment system, according to various aspects of the disclosure.

The present disclosure relates generally to a hose deployment and retrieval device. In particular, but not by way of limitation, the present disclosure relates to systems, methods and apparatuses for deploying and retrieving hoses.

The word "exemplary" is used herein to mean "serving as an example, instance, or illustration." Any embodiment described herein as "exemplary" is not necessarily to be construed as preferred or advantageous over other embodiments.

Spatially relative terms, such as "beneath," "below," "lower," "under," "above," "upper," and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" or "under" other elements or features would then be oriented "above" the other elements or features. Thus, the exemplary terms "below" and "under" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the disclosure. As used herein, the singular forms "a," "an," and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items, and may be abbreviated as "/".

It will be understood that when an element or layer is referred to as being "on," "connected to," "coupled to," or "adjacent to" another element or layer, it can be directly on, connected, coupled, or adjacent to the other element or layer, or intervening elements or layers may be present. In contrast, when an element is referred to as being "directly on," "directly connected to," "directly coupled to," or "immediately adjacent to" another element or layer, there are no intervening elements or layers present.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and/or the present specification and will not be interpreted in an idealized or overly formal sense unless expressly so defined herein.

Figure 3:
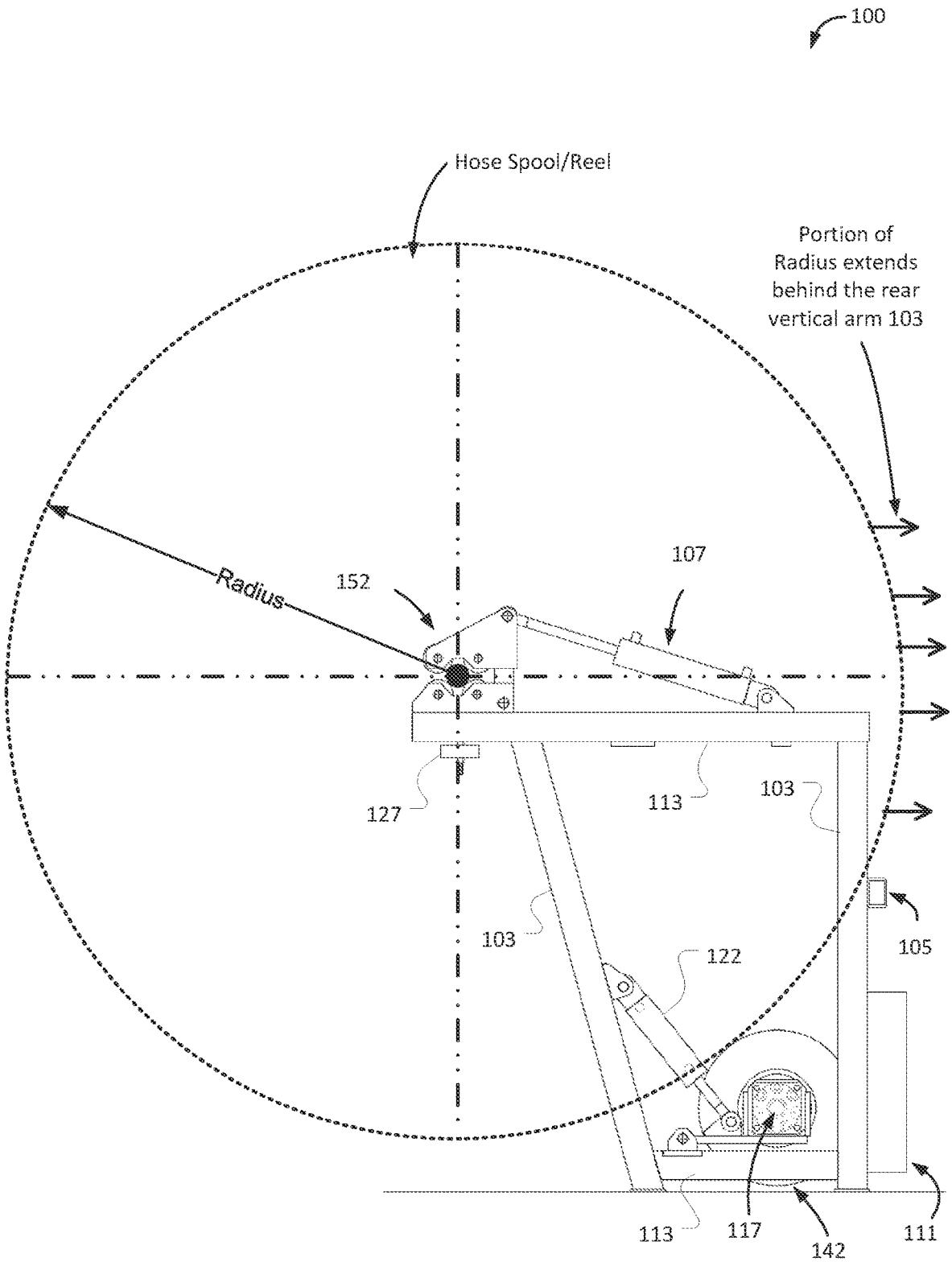
FIG. 3 illustrates a side view of the hose deployment system in FIG. 1, according to various aspects of the disclosure.

As used herein, the terms "distal" and "front" shall refer to a side or direction associated with a direction of intended hose deployment; for example, in FIGS. 1 and 3, the front or distal side is towards the left. Further, the terms "back", "rear", or "proximal" shall be associated with the intended attachment point (or bracing) of the hose deployment/retrieval system. For example, in FIGS. 1 and 3, the rear or proximal side is towards the right. When referencing a vertical direction, the term "distal" shall refer to a low or bottom side of an object, for example, the side closer to the ground or floor. For instance, in FIGS. 1 and 3, the distal side of the hose deployment/retrieval system is towards the bottom of the page. Additionally, when referencing a vertical direction, the term "proximal" shall refer to an upper or top side of an object, for example, the side away from the ground or floor. For example, in FIGS. 1 and 3, the proximal side of the hose deployment/retrieval system is towards the top of the page.

Aspects of the disclosure generally relate to a hose deployment and retrieval system configured to receive and/or support a hose reel via a frame with a motorized reel and a CG closer to the transport vehicle than has been possible in the art. In some cases, the system can be used to retrieve a hose (e.g., a collapsible lay-flat hose) on a hose reel. In some embodiments, the hose may be used to transport large quantities of fluid to a well site (e.g., a hydraulic fracturing well site). In other embodiments, the hose may be used to transport gases or a combination of liquid and gas. In some circumstances, lay-flat hoses are stored and transported to the well site on a reel/spool. At the well site, the reel/spool around which the hose is wound is removed from the transport vehicle (e.g., an industrial load such as a skid steer) and unrolled along the ground to a fluid source. Alternatively, lay-flat hoses are stored and transported to the well set on a reel/spool and then deployed (unwound) as the transport vehicle is moving and carrying the hose deployment and retrieval system. For instance, the transport vehicle may travel in a reverse direction while unwinding the coiled hose thereby laying the hose along an intended path traversed by the transport vehicle.

Current hose deployment/retrieval systems are lacking in several regards. For example, many current hose deployment/retrieval systems are limited to a maximum hose diameter due to weight and CG concerns, such that current systems tend to avoid hose diameters of 10" or greater. In addition, current hose deployment/retrieval systems are heavy and can require a larger, or more cumbersome transport vehicle, and more costly deployment system materials. The disclosed hose deployment/retrieval system is configured for use with larger diameter hoses (e.g., 10 inches or greater and in some cases at least 14- or 16-inch hoses) as compared to the prior art, while enabling a lower overall weight, lower manufacturing costs and/or a more optimal CG position (e.g., more proximal). In some aspects, such a design may allow the operator to transport larger volumes of fluid (e.g., water) to the well site, enable the hose deployment/retrieval system to be transported on a smaller/lighter transport vehicle, lower manufacturing costs and broaden the types of areas (e.g., rugged hilly terrain) where the system can be deployed, as compared to the prior art.

Turning now to FIG. 1, which illustrates an isometric view of a hose deployment and retrieval system 100 (or simply hose system 100), according to various aspects of the disclosure. As seen, the hose system 100 comprises a frame assembly 102 having a plurality of vertical arms 103 (or upward oriented arms) and a plurality of horizontal arms 113, and one or more attachment plates 111. In some embodiments, hose system 100 comprises one or more cross beams 110 and/or reinforcement plates 120. For example, with reference to an embodiment in FIG. 1, the hose system 100 comprises four (4) vertical arms 103, two at each of the front (or distal) and rear (or proximal) sides of the hose system 100. In addition, the hose system 100 comprises four horizontal arms 113, two near the top end of the hose system 100 and two near the bottom end of the hose system 100.

In some embodiments, the two vertical arms 103 positioned at the front/distal side of the hose system 100 are placed at an angle (e.g., with respect to the rear vertical arms 103), while the two vertical arms 103 positioned at the rear/proximal side of the hose system 100 are perpendicular or substantially perpendicular to the floor/ground when the hose system is placed on the ground. In particular, the angle slopes down from the distal toward the proximal ends of the system 100. For instance, the two vertical arms 103 positioned at the front/distal side of the hose system 100 may be angled (e.g., anywhere between 15-30 degrees in the counterclockwise direction in FIGS. 1 and 3) with respect to the lower horizontal arms 113 or the floor/ground. Other angles (e.g., >30 degrees, <15 degrees) are contemplated in different embodiments, and the examples listed herein are not intended to be limiting.

In some embodiments, hose system 100 comprises one or more horizontal arms 113 coupled near or on the top (or proximal) end of each pair of vertical arms 103, where each pair of vertical arms 103 comprises a perpendicular vertical arm 103 (i.e., at the rear/proximal end of the hose system 100) and an angled vertical arm 103 (i.e., at the front/distal end of the hose system). In some cases, each of the angled vertical arms 103 is at an angle (e.g., anywhere between 15-30 degrees) with respect to a perpendicular (or vertical axis). In some cases, the selection of the angle may also help provide for a more optimal CG location (e.g., closer to the attachment plate 111), reduce the overall weight of the hose system, allow for a more compact system, or a combination thereof. As seen, each horizontal arm 113 spans between the vertical arms of a corresponding pair of vertical arms 103 and is slightly longer than the maximum separation between the respective vertical arms 103. In some cases, the width of the horizontal arm 113 is equal or substantially equal to the width of each of the vertical arms 103. Alternatively, the horizontal arm 113 may be slightly wider than the vertical arms 103. In some embodiments, the frame assembly 102 also comprises two horizontal arms 113 positioned at the distal (bottom) side, where each of the distal horizontal arms 113 is positioned between the vertical arms of a corresponding pair of vertical arms 113. The distal horizontal arms 113 can be equal to a separation between distal ends of the vertical arms 103. Further, the proximal horizontal arms 113 can be longer than the distal horizontal arms 113. These various arms can be welded or bolted together, though other coupling means are also possible.

In some embodiments, the attachment plate 111 is positioned at the rear/proximal side of the hose system 100 and is attached or coupled to each of the rear vertical arms 103. In some embodiments, the width of the attachment plate 111 is at least as wide, and sometimes slightly greater, than the separation between the rear vertical arms 103. The attachment plate 111 can also be positioned toward a bottom/distal end of the frame assembly 102. The attachment plate 111 is configured to attach to one or more different vehicles. For example, in some embodiments, attachment plate 111 is configured to attach to a front end of a skid steer. In other embodiments, attachment plate 111 is configured to attach to other vehicles such as trucks, backhoes, loaders, and the like.

In various embodiments, a wheel and tire assembly 142, a dynamic fluid component 140 (e.g., a motor), and a plurality of pneumatic arms 122 can be attached to the frame assembly 102. In some embodiments, other elements can also be attached to the frame.

In some embodiments, the wheel/tire assembly 142 and the dynamic fluid component 140 are positioned on a proximal (top) side of one of the distal horizontal arms 113. In some embodiments, the wheel/tire assembly 142 (also referred to as drive wheel 142) comprises a rubber tire that contacts the hose reel/spool to drive it via friction, which allows the hose to be deployed and retrieved (e.g., see FIG. 3). The drive wheel may also be made from other flexible and/or high-friction materials, such as silicone, vinyl, and synthetic rubbers, such as those made from Parenchyma and/or other plants, and is thus not limited to rubber or natural rubber. In some cases, the drive wheel 142 is driven using a motor (not shown) coupled to the frame assembly 102. In some embodiments, the motor is positioned low and proximally towards the skid steer attachment plate 111. In one non-limiting example, the motor is positioned below the dynamic fluid component 140, for instance, between the dynamic fluid component 140 and the attachment plate 111. Other locations for the motor are contemplated in different embodiments, and the example locations described herein are not intended to be limiting.

In some embodiments, drive wheel 142 provides traction and rotation to deploy or retrieve hoses. In some embodiments, it is configured as a powered wheel that engages with the hose reel or spool, enabling controlled movement of the hose during deployment or retrieval. In some embodiments, drive wheel 142 is connected to a motor or other power source, which drives its rotation. This rotation, in turn, moves the hose reel or spool, allowing the hose to be unwound or wound back onto the reel. In some hose embodiments, the drive wheel may be adjustable in speed or direction to accommodate different deployment or retrieval scenarios. It may also be equipped with features such as grip-enhancing surfaces or tread patterns to ensure adequate traction, especially when dealing with heavy or unwieldy hoses.

In some cases, a pneumatic assembly 122 comprising a bore and stroke is coupled at or near the drive wheel 142. For example, the pneumatic assembly 122 is positioned at a proximal (top) side of the one of the distal horizontal arms 113 and shaped and sized to extend between the drive wheel 142 and one of the angled vertical arms 103. In some cases, the pneumatic assembly 122 helps moderate the tension between the drive wheel 142 (i.e., wheel/tire assembly 142) and the hose reel (not shown) and/or to dampen vibrations such that the drive wheel 142 maintains a more consistent pressure on the hose reel/spool.

In many embodiments, the frame assembly 102 further includes a horizontal beam or brace 105 that is positioned above (or on a proximal side) of the attachment plate 111, where the horizontal beam 105 extends between the rear vertical arms 103 of the frame assembly 102. In some embodiments, the horizontal beam 105 is positioned midway (or roughly midway) along the height of the rear vertical arms 103 and below (or on a distal side) of each of the proximal horizontal arms 113. In other embodiments, the horizontal beam 105 is positioned at other points along the height of the rear vertical arms.

In some embodiments, there is no horizontal beam in the middle or upper/proximal portion of the rear of the frame assembly. In these embodiments, the design enables the hose reel/spool to be moved further back (i.e., towards the skid steer, or another transport vehicle) as compared to the prior art since the hose real/spool can partially fit through the opening left by the absence of the upper/middle horizontal beam (e.g., see FIG. 3). In other words, a radius of the hose reel/spool is able to extend proximal to the attachment plate 111 and the horizontal beam 105 (i.e., rearward of the frame assembly 102). This moves the center of gravity (or CG) of the hose system 100 closer to the transport vehicle, which minimizes or reduces the likelihood of the transport vehicle tipping over when heavier hoses (e.g., 14- or 16-inch diameter hoses) or longer hoses are wound around the hose reel/spool.

While existing frame assemblies tend to have a square cross section with relatively equal height and width, the current disclosure describes a cross section (viewed from the side) that is taller than it is wide (i.e., vertical arms 103 are significantly longer than horizontal arms 113). This shape plays a role in moving the CG rearward and allowing the transport vehicle to lift heavier loads thereby allowing larger-diameter hose, or longer hose, to be transported and deployed.

In some embodiments, the hose reel/spool (not shown) comprising the lay-flat hose is positioned between the angled vertical arms 103 of the frame assembly 102. As seen, a pneumatic assembly 107 and a claw assembly 152 are positioned on the top/proximal side of each of the proximal horizontal arms 113. Further, each of the pneumatic assemblies 107 is coupled at one end to a corresponding one of the proximal horizontal arms 113, and at another end to one of the claws of the claw assembly 152. Additionally, a second claw of each of the claw assemblies 152 is coupled to a corresponding one of the proximal horizontal arms 113. In some cases, the claw assemblies are positioned at or near the front/distal ends of the proximal horizontal arms 113.

In some examples, each of the claw assemblies 152 comprises one or more rollers 154. Further, the pneumatic assembly 107 and the claw assembly 152, which serve as the clamping system, on each of the proximal horizontal arms 113 help facilitate in clamping a spool adapter attachment (e.g., spool adapter attachment 600-*a* in FIG. 6) and securing it with respect to the frame assembly 102. In some cases, the separation between the claws and/or rollers of a respective claw assembly may be adjusted by way of the pneumatic assembly 107. In this way, the claw assemblies can be used to secure spool adapter attachments of different sizes, types, etc. In some cases, a spool adapter attachment 600 (e.g., spool adapter attachment 600-*a*, 600-*b*) is positioned on each side of the hose reel/spool, for instance, on an inside of a respective claw assembly, which helps mount the hose reel/spool on the frame assembly 102. The spool adapter attachment(s) 600 allow spools of different widths to be used with the same hose deployment/retrieval system 100. In contrast, certain prior art hose deployment/retrieval systems can only support spools of a single width. That is, a different hose deployment/retrieval system is needed for each hose or spool width.

In this example, one of the proximal horizontal arms 113 further comprises a roller guide wheel 127 positioned below (distal side) the horizontal arm 113. As seen, the roller guide wheel 127 is positioned at or near a front/distal end of the proximal horizontal arm 113. The roller guide wheel 127 helps keep the spool from moving from one side (e.g., front side) of the hose deployment/retrieval system 100 to the other side (e.g., rear side that is closer to the vehicle) and subsequentially making contact with the deployment vehicle. Additionally, the roller guide wheel 127 also helps keep the ring of the spool properly aligned with the drive wheel 142.

Figure 2:
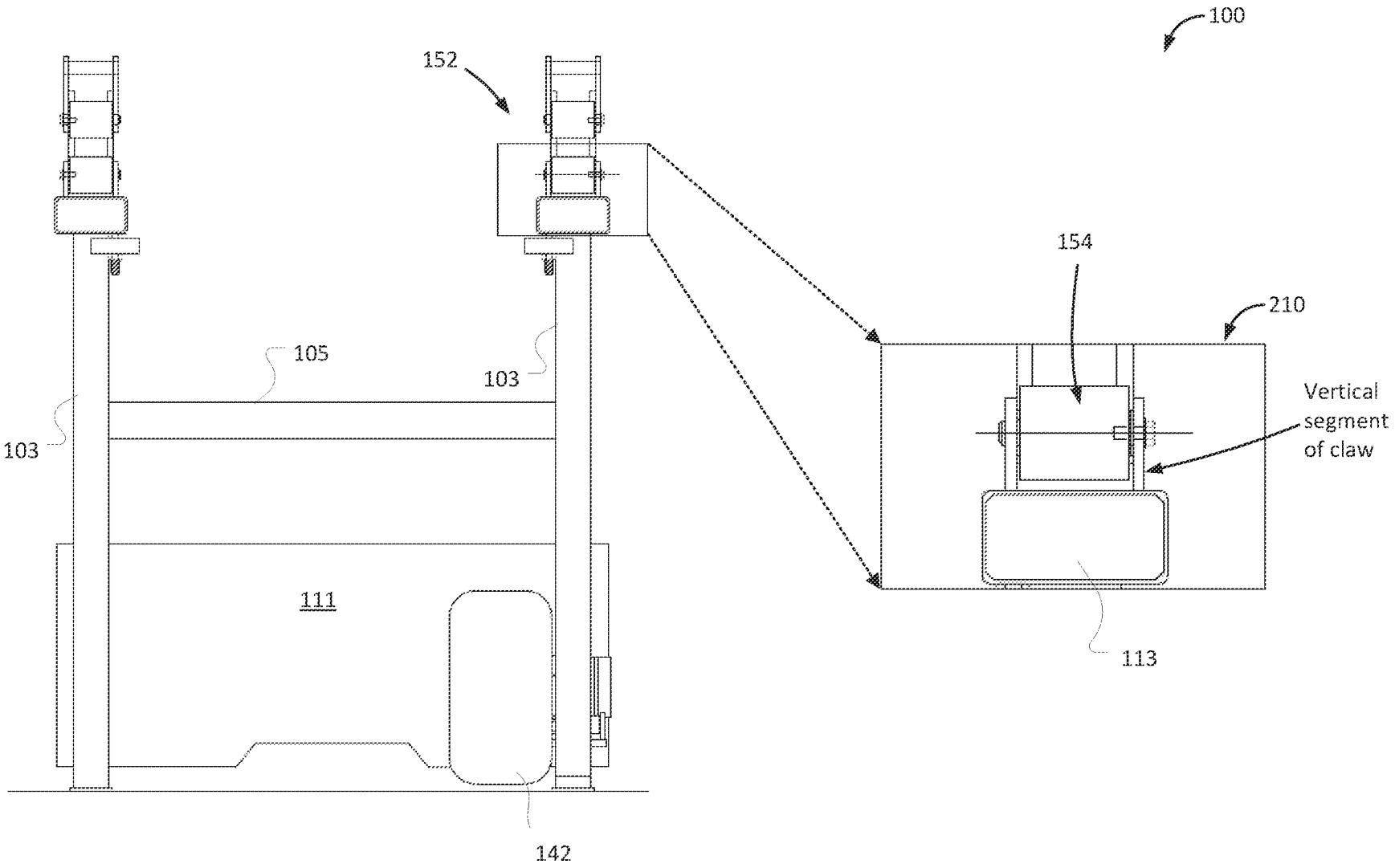
FIG. 2 illustrates a front view of the hose deployment system in FIG. 1, according to various aspects of the disclosure.

FIG. 2 illustrates a front view of the hose deployment/retrieval system 100 in FIG. 1, according to various aspects of the disclosure. FIG. 2 also depicts a detailed view 210 of a bottom portion of a claw assembly 152 showing the proximal horizontal arm 113, the vertical segments of the claw, and a roller 154, where the roller 154 is positioned between the two vertical segments of the claw. As seen, each of the vertical segments of the claw are positioned on opposing sides (e.g., left and right in the figure) of the proximal horizontal arm 113.

FIG. 3 illustrates a side view of the hose deployment/retrieval system 100 in FIG. 1, according to various aspects of the disclosures. As seen, FIG. 3 depicts the hose spool/reel (shown in dashed lines) including its center (e.g., shown by the black circle at or near the center of the claw assembly). FIG. 3 also depicts exemplary spokes of the hose spool (dash-dot lines), though other hose spools may include fewer or more than the four spokes shown. In some examples, the location of the beam 105 is low enough on the proximal vertical arms 103 to allow a portion of the radius of the hose spool/reel to extend behind the rear vertical arms 103. As noted above, this enables the CG of the hose deployment/retrieval system 100 to be moved rearward (or closer to the transport vehicle), as compared to the prior art. In some cases, the radius of the hose spool may be anywhere between 3-5 feet, for instance, at or around 4 feet. Other radii of the hose spool/reel are contemplated in different embodiments and the dimensions listed herein are exemplary only. In some examples, the radius of the hose spool that may be supported by the hose deployment/retrieval system 100 is based at least in part on the length of the proximal horizontal arm 113. For example, the radius of the hose spool may be equal or substantially equal to the length of proximal horizontal arm 113, which allows at least a portion of the radius to extend behind the rear vertical arm. In other cases, the length of the longer/proximal horizontal arm 113 is selected to be slightly shorter than the radius of the hose spool/reel. Additionally, or alternatively, the angle of the front/distal vertical arms, i.e., with respect to the horizontal arms, can be selected based on the radius of the hose spool. For instance, a larger angle may be utilized when the radius of the spool is larger. Alternatively, the angle may be kept the same or substantially the same (e.g., between 15-30 degrees), while the length of each of the distal and proximal horizontal arms may be increased to accommodate a larger hose spool/reel. Other variations of angles, lengths, etc., can be utilized without departing from the scope and/or spirit of this disclosure. In some cases, the bottom of the hose spool/reel is at or around the middle (vertical direction) of the attachment plate 111. Alternatively, the bottom of the hose spool/reel may extend slightly below the midpoint (in the vertical direction) of the attachment plate 111. Thus, as seen, the location of the horizontal beam/brace 105 allows some of the weight of the hose spool/reel to be shifted rearward and closer to the skid steer (or other transport vehicle), which improves the weight distribution of the system 100 compared to the prior art.

Figure 4:
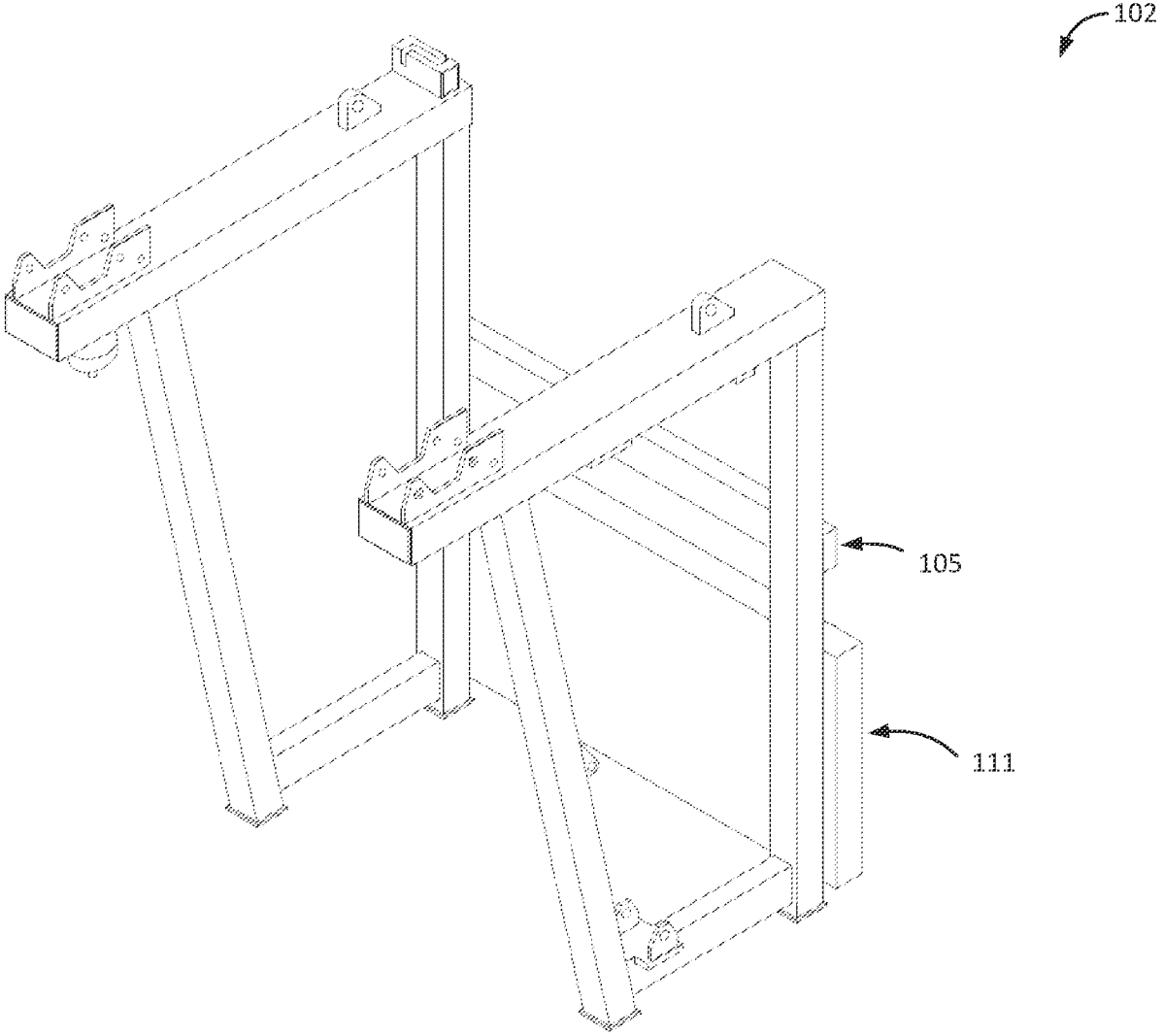
FIG. 4 illustrates an isometric view of a frame assembly of the hose deployment system in FIG. 1, according to various aspects of the disclosure.

FIG. 4 illustrates an isometric view of the frame assembly 102 of the hose deployment/retrieval system 100 in FIG. 1, according to various aspects of the disclosure. This view is similar to that of FIG. 1, but with certain components removed to provide better visibility of the frame structure.

Figure 5:
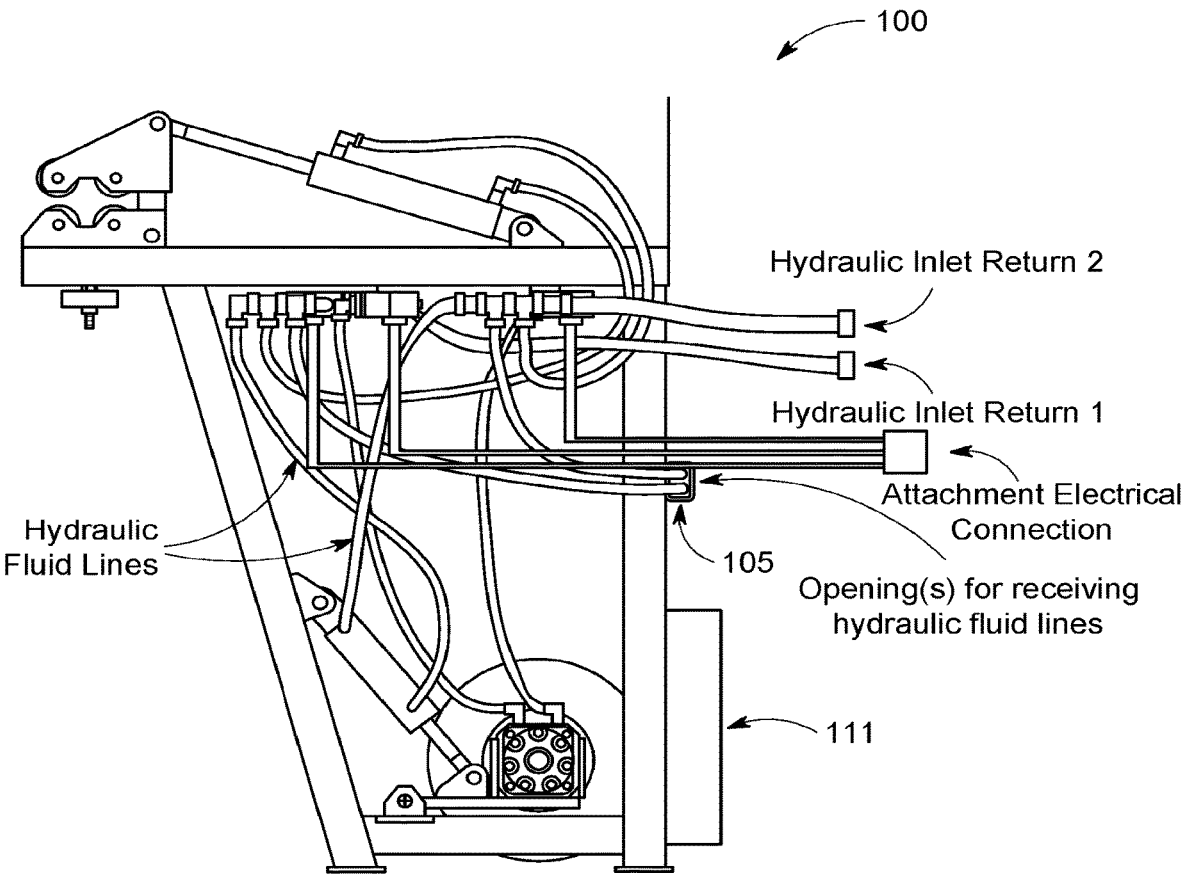
FIG. 5 illustrates another side view of the hose deployment system, according to various aspects of the disclosure.

FIG. 5 illustrates another side view of the hose deployment/retrieval system 100 in FIG. 1, according to various aspects of the disclosure. Specifically, FIG. 5 depicts an example of the various hydraulic fluid lines, electrical lines, hydraulic inlet returns, and electrical connection attachments that may be coupled to the pneumatic assemblies (e.g., pneumatic assemblies 107, 122), the drive wheel (e.g., drive 142), including the motor, and/or the dynamic fluid component (e.g., dynamic fluid component 140). As seen, in some embodiments, the horizontal beam/brace 105 coupled to the rear/proximal vertical arms can be hollow or comprises one or more openings that are shaped and sized to receive one or more hydraulic fluid lines (or alternatively, electrical lines). As noted above, the position of the beam/brace 105 between the distal (bottom) end of the hose system 100 and the proximal horizontal arm enables the hose spool/reel to be positioned further back (e.g., towards the skid steer or transport vehicle), as compared to the prior art. Such a design helps optimize the weight distribution of the hose system 100 and allows one or more of (1) larger diameter and/or heavier hoses to be used without the concern of vehicle tipping or damage, (2) reduces overall weight of the system 100, and (3) makes for a more compact system. For example, the increased height of the frame assembly 102 as compared to prior art designs allows the spool assembly to sit further back into the hose deployment/retrieval system 100, which also helps bring the load (e.g., spool and hose) closer to the deployment vehicle.

Figure 6A:
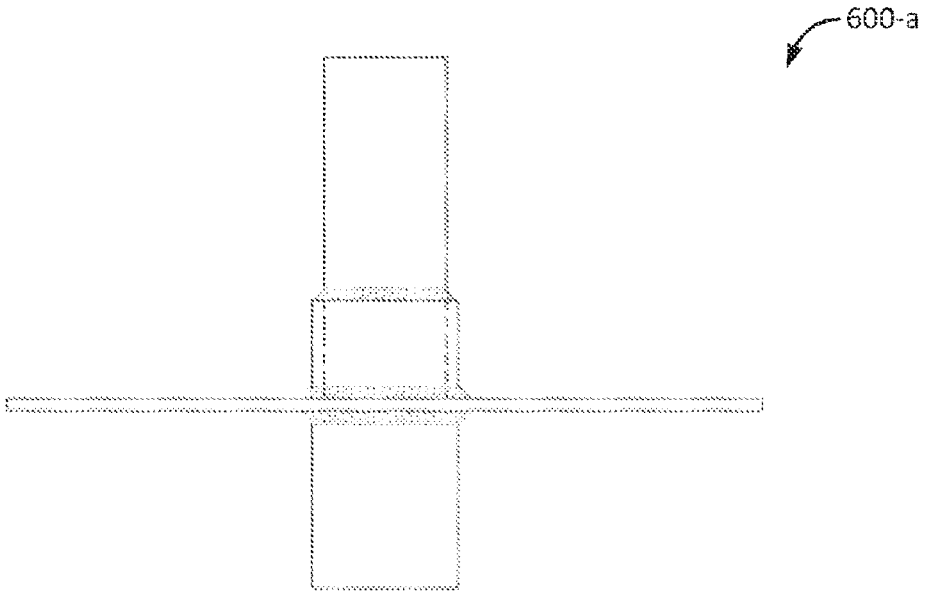
FIG. 6A illustrates a top view of a spool adapter attachment configured for use with a hose deployment system, according to various aspects of the disclosure.
Figure 6B:
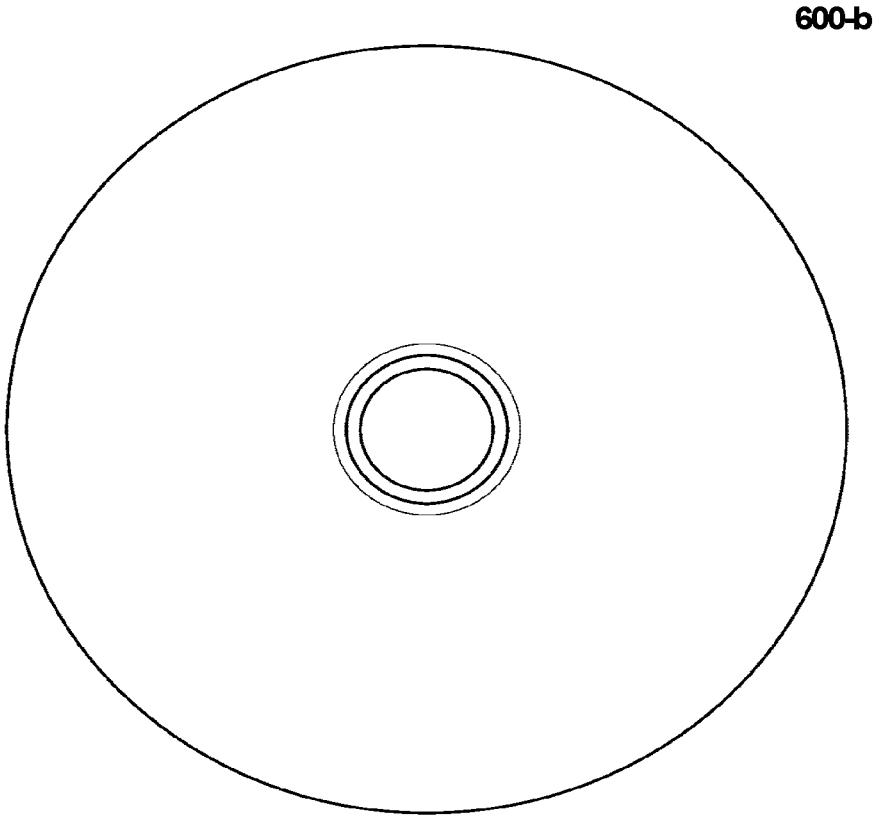
FIG. 6B illustrates a front view of the spool adapter attachment in FIG. 6A, according to various aspects of the disclosure.

FIGS. 6A and 6B illustrate a top view (600-*a*) and a side view (600-*b*), respectively, of a spool adapter attachment configured for use with the hose deployment/retrieval system 100, according to various aspects of the disclosure. As noted above, the spool adapter attachment(s) 600 allow spools of different widths to be used with the same hose deployment/retrieval system 100.

Figure 7:
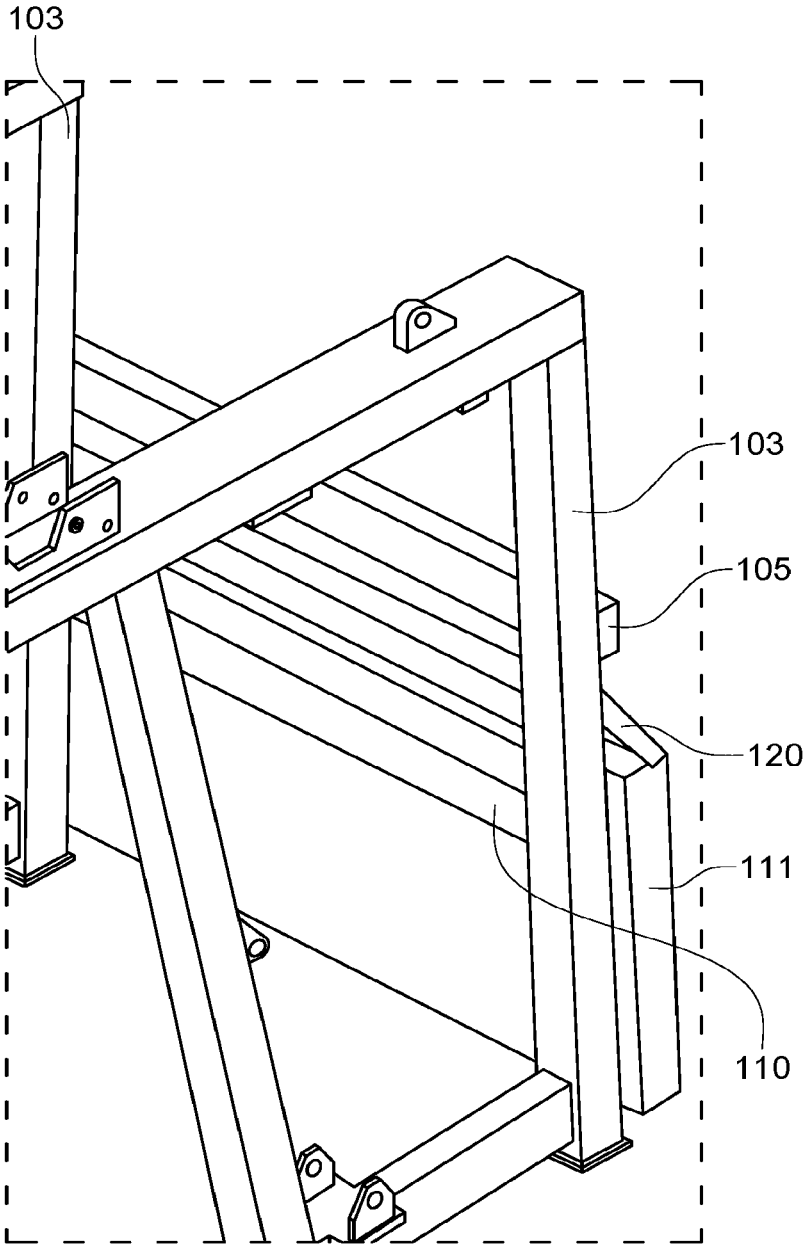
FIG. 7 an isometric view of a frame assembly according to various aspects of the disclosure.

FIG. 7 illustrates an isometric view of the frame assembly 102 of the hose deployment/retrieval system 100 in FIG. 1, according to other aspects of the disclosure. For example, in some embodiments, frame assembly 102 comprises one or more cross beams 110 arranged substantially parallel to horizontal beam 105. In some embodiments, the frame assembly comprises one or more cross beams 110 arranged adjacent to the attachment plate 111. In various embodiments, cross beam 110 is fixedly coupled to the attachment plate 111 at a front side of the plate 111 (a distal side of the plate 111), near or at a top end of the attachment plate 111. In some embodiments, cross-beam 110 is fixedly coupled to one side of vertical arms 103, while the attachment plate 111 is coupled to the other side of vertical arms 103. In some embodiments, and as illustrated in FIG. 7, cross beam 110 is coupled to interior sides of arms 103, such that it spans a section between the two vertical arms 103 and attachment plate 111 is coupled to a back side of the vertical arms 103.

Figure 8:
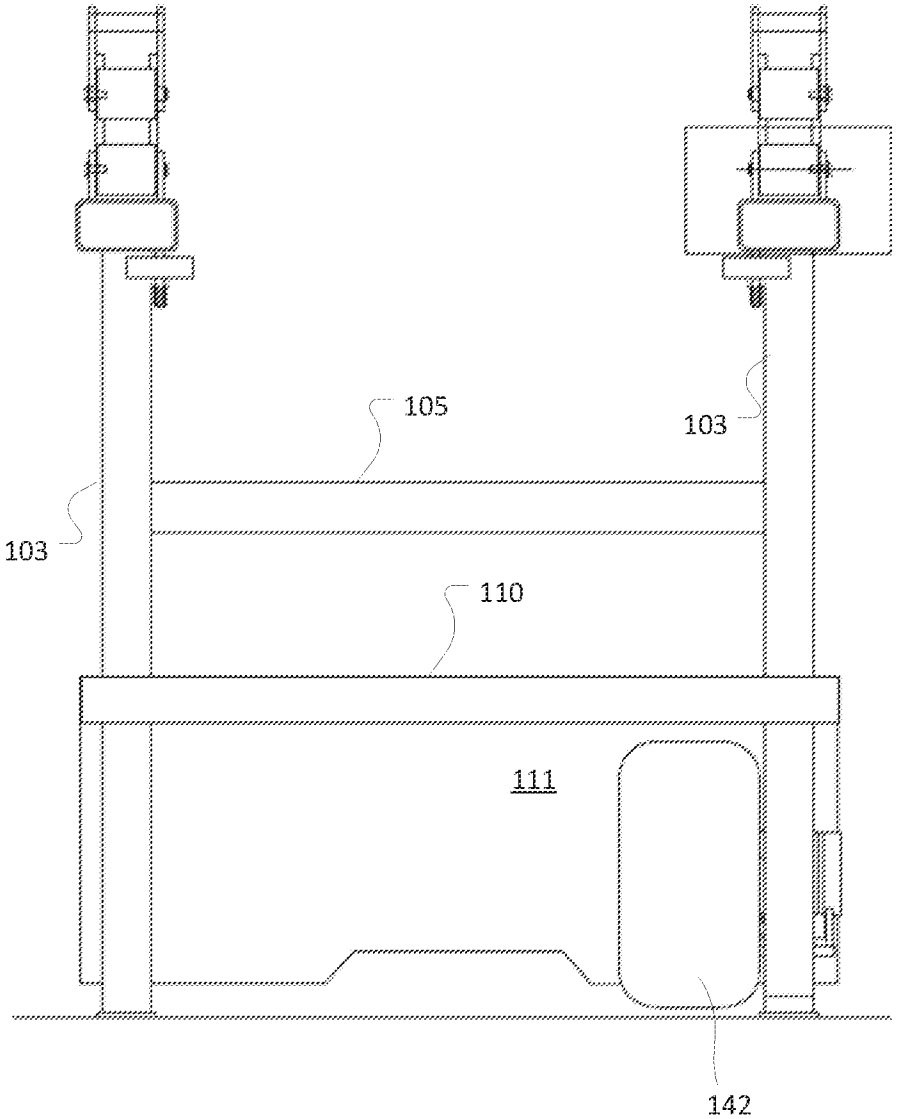
FIG. 8 is a front view of a frame assembly according to various aspects of the disclosure.

In other embodiments, illustrated in FIG. 8, cross beam 110 is coupled to a distal side of vertical arms 103 and has a length slightly longer than the distance between the two vertical arms 103. Attachment plate 111 is attached to a back side of vertical arms 103. In some embodiments, the length of cross beam 110 is approximately the same as the length of attachment plate 111. In some embodiments, the length of cross beam 110 is less than the length of attachment plate 111 or greater than the length of attachment plate 111. In some embodiments, cross beam 110 is arranged approximately even to the top portion of attachment plate 111. In some embodiments, cross beam 110 is arranged below the top portion of attachment plate 111.

Figure 9:
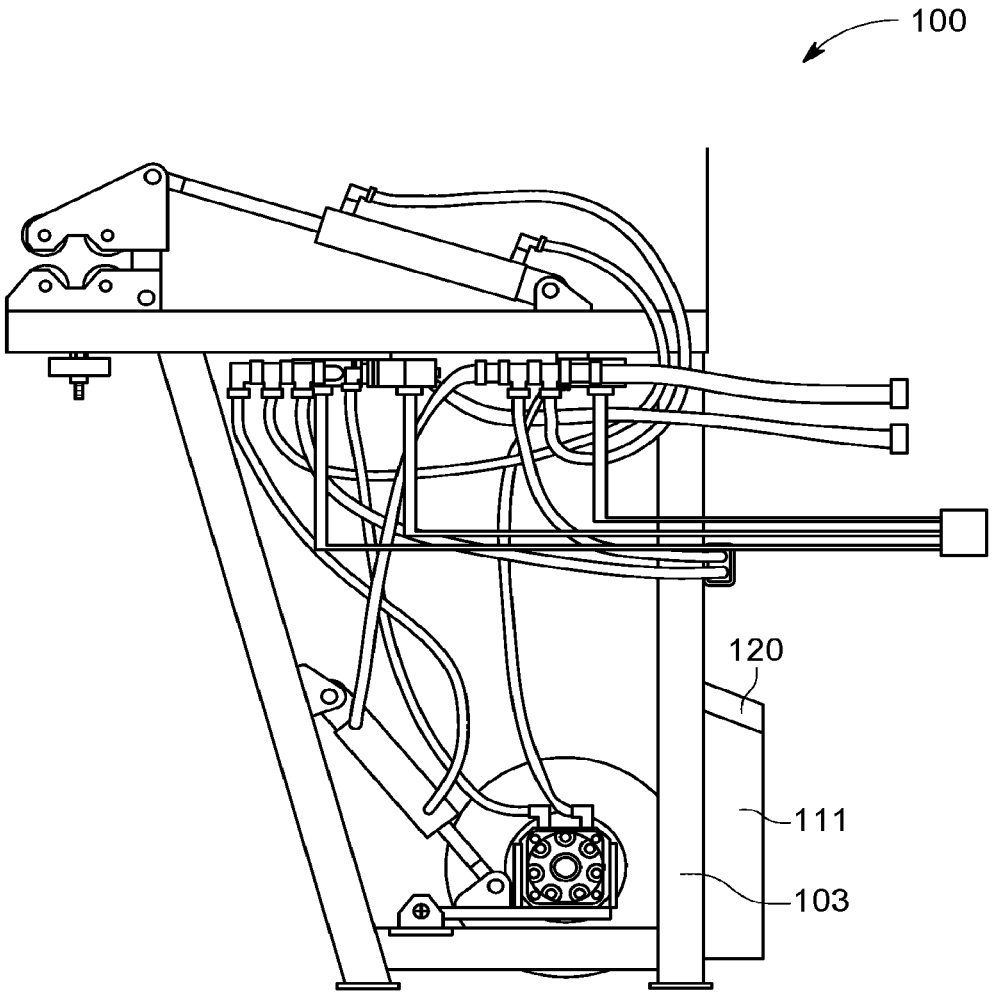
FIG. 9 is a side view of a frame assembly according to various aspects of the disclosure.

Referring back to FIG. 7 and with reference to FIG. 9, one or more reinforcement plates 120 can be arranged adjacent to and along a top of the attachment plate 111 to provide additional rigidity. The reinforcement plate 120 is attached to a top portion of attachment plate 111. In some embodiments, the top portion of attachment plate 111 is shaped to conform to the shape of reinforcement plate 120 (e.g., can have an angular side profile). In some embodiments, reinforcement plate 120 is fixedly coupled to a back side of the plate 111 at or near the same lateral height as the cross beam 110. In such embodiments, both the cross beam 110 and the reinforcement plate 120 provide further support for the attachment plate 111. In some embodiments, reinforcement plate 120 is configured to affix to vertical arm 103 at an angle. In such embodiments, at least a portion of the top portion of attachment plate 111 is formed such that at least of portion of reinforcement plate 120 can nestle within and affix to a top portion of attachment plate 111. A side and/or edge portion of the reinforcement plate 120 is fixedly attached to vertical arms 103.

Figure 10:
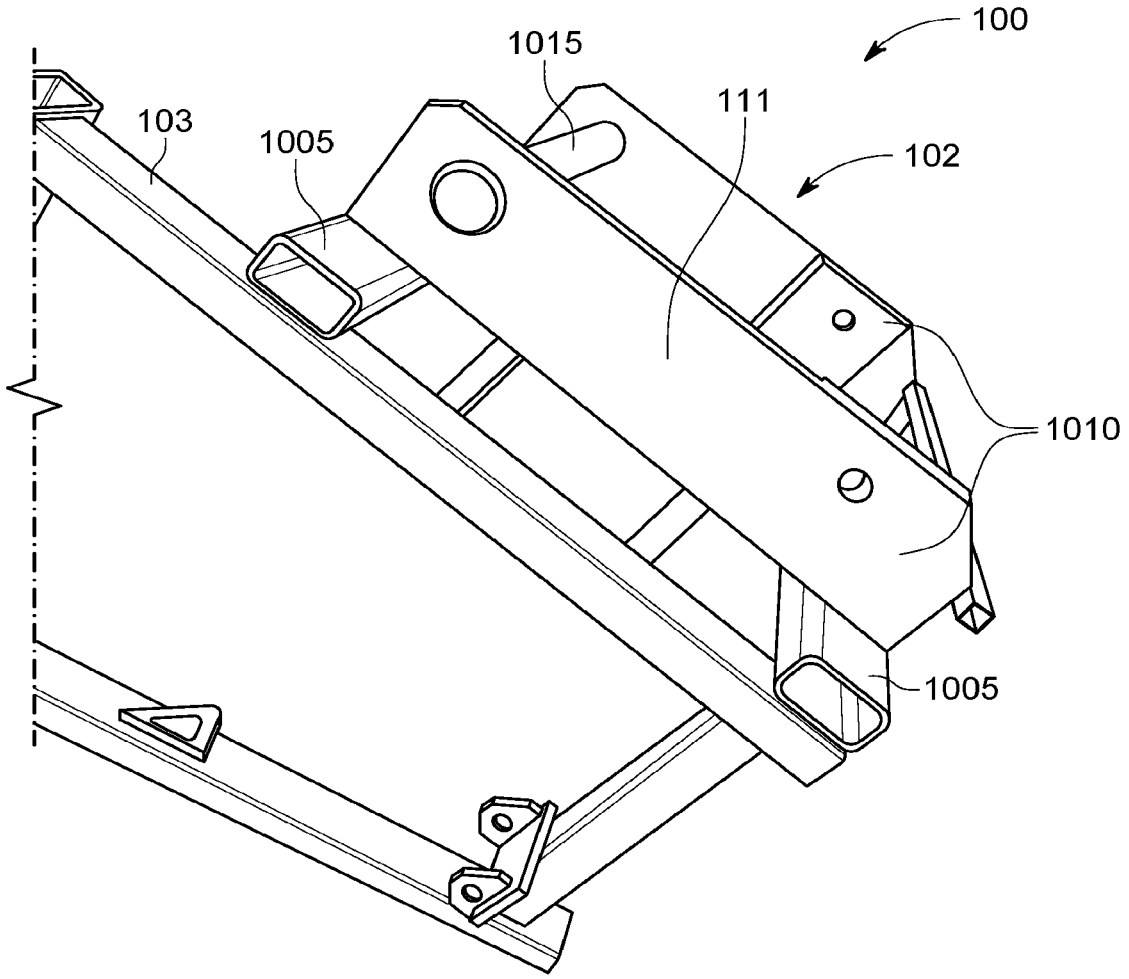
FIG. 10 illustrates an embodiment of attachment plate and frame assembly in accordance with aspects of the disclosure.

FIG. 10 illustrates an embodiment of attachment plate 111 and frame assembly 102 in accordance with other aspects of the disclosure. Attachment plate 111 is configured for use with a telehandler. In some embodiments, attachment plate 111 comprises a solid metal plate affixed to frame assembly 102, that has a generally rectangular structure. In some embodiments, attachment plate comprises two elongated and generally rectangular side plates 1010 that each extend proximally from the back side of frame assembly 102. The side plates 1010 are coupled together by one or more beams 1015 (or other spanners) that span horizontally between the two side plates 1010. In some embodiments, attachment plate 111 includes a back plate to which each of the side plates 1010 is affixed to and extends from. In some embodiments, the side plates 1010 are fixedly coupled to one or more attachment beams 1005 that affix the side plates 1010 to the frame assembly 102 at a bottom portion and a top portion of each side plate. In some embodiments, attachment beams 1005 are fixedly coupled to a back side of the frame assembly 102 along a lower portion of vertical arms 103. In these embodiments, the one or more attachment beams 1005 serve to further push the CG proximally.

As used herein, the recitation of "at least one of A, B and C" is intended to mean "either A, B, C or any combination of A, B and C." The previous description of the disclosed embodiments is provided to enable any person skilled in the art to make or use the present disclosure. Various modifications to these embodiments will be readily apparent to those skilled in the art, and the generic principles defined herein may be applied to other embodiments without departing from the spirit or scope of the disclosure. Thus, the present disclosure is not intended to be limited to the embodiments shown herein but is to be accorded the widest scope consistent with the principles and novel features disclosed herein.

What is claimed is:

1. A hose deployment and retrieval system, comprising:

a frame assembly with a plurality of vertical arms positioned at both front and rear sides of the hose deployment and retrieval system, with a front vertical arms angled with respect to a rear vertical arms and wherein each of the angled vertical arms is positioned at an angle between 15-30 degrees with respect to a perpendicular axis;

a plurality of horizontal arms attached to pairs of vertical arms, each pair comprising a rear perpendicular vertical arm and a front angled vertical arm;

an attachment plate positioned at a rear side of the system and coupled to each of the rear vertical arms, the attachment plate being configured for attachment to a transport vehicle;

a drive wheel assembly and a dynamic fluid component coupled to the frame assembly, the drive wheel assembly comprising a circular object configured to contact a hose reel and facilitate hose deployment and retrieval, the drive wheel assembly being driven by a motor.

2. The hose deployment and retrieval system of claim 1, wherein each horizontal arm spans between the vertical arms of a corresponding pair of vertical arms and is slightly longer than a maximum separation between the respective vertical arms.

3. The hose deployment and retrieval system of claim 1, wherein the attachment plate is at least as wide as a separation between the rear vertical arms.

4. The hose deployment and retrieval system of claim 1, further comprising two horizontal arms positioned at a bottom side of the frame assembly, each distal horizontal arm positioned between the vertical arms of a corresponding pair of vertical arms, and each proximal horizontal arm being longer than the distal horizontal arms.

5. The hose deployment and retrieval system of claim 4, wherein the frame assembly further comprises:

two claw assemblies, wherein each claw assembly positioned on one of the proximal horizontal arms, the two claw assemblies configured to facilitate secure attachment of spool adapter attachments; and two pneumatic assemblies, wherein each pneumatic assembly is coupled to the proximal horizontal arms and the claw assemblies, enabling adjustment for securing spool adapter attachments of different sizes.

6. The hose deployment and retrieval system of claim 1, further comprising roller guide wheels positioned on proximal horizontal arms.

7. The hose deployment and retrieval system of claim 1, wherein the attachment plate is configured for use with a telehandler, the attachment plate comprising a solid metal plate affixed to the frame assembly, and further comprising two elongated and generally rectangular side plates extending outward from a back side of the frame assembly, wherein the side plates are coupled together by one or more beams spanning horizontally between the side plates.

8. The hose deployment and retrieval system of claim 1, further comprising:

a hose spool having a radius; and a cross beam positioned to allow a portion of the radius of the hose spool to extend behind the rear perpendicular vertical arms when the hose spool is attached to the frame assembly;

wherein the radius of the hose spool being supported by the hose deployment and retrieval system based at least in part on a length of the longer pair of horizontal arms.

9. The hose deployment and retrieval system of claim 8, wherein the angle of the front angled vertical arms with respect to the horizontal arms is selected based on the radius of the hose spool.

10. A frame assembly for a hose deployment/retrieval system, comprising:

a first distal vertical arm and a second distal vertical arm;

a first proximal vertical arm and a second proximal vertical arm;

a first horizontal arm connecting the first distal vertical arm and the first proximal vertical arm at a top portion of the first distal vertical arm and the first proximal vertical arm;

a second horizontal arm connecting the first distal vertical arm and the first proximal vertical arm at a bottom portion of the first distal vertical arm and the first proximal vertical arm;

a third horizontal arm connecting the second distal vertical arm and the second proximal vertical arm at a top portion of the second distal vertical arm and the second proximal vertical arm;

a fourth horizontal arm connecting the second distal vertical arm and the second proximal vertical arm at a bottom portion of the second distal vertical arm and the second proximal vertical arm;

a first cross beam fixedly coupled to the first proximal vertical arm and the second proximal vertical arm, wherein the first cross beam is arranged adjacent to an attachment plate of the frame assembly;

wherein the attachment plate is coupled to a back side of the first proximal vertical arm and a back side of the second proximal vertical arm; and a second cross beam coupled to a different portion of the first proximal vertical arm and the second proximal vertical arm, wherein the second cross beam is coupled at a height along the first proximal vertical arm and the second proximal vertical arm adjacent a height of a top of the attachment plate.

11. The frame assembly of claim 10, further comprising a reinforcement plate arranged adjacent to and along a top of the attachment plate, wherein the reinforcement plate is fixedly coupled to a back side of the attachment plate at or near a height of the second cross beam.

12. The frame assembly of claim 10, further comprising:

a hose spool having a radius; and the first cross beam positioned to allow a portion of the radius of the hose spool to extend behind the proximal vertical arms when the hose spool is attached to the frame assembly;

wherein the radius of the hose spool being supported by the frame assembly based at least in part on a length of the first horizontal arm and a length of the third horizontal arm.

13. The frame assembly of claim 12, wherein the radius of the hose spool is substantially equal to a length of the first horizontal arm and a length of the third horizontal arm.

* * * * *